US011485144B2

(12) United States Patent
Otokita et al.

(10) Patent No.: US 11,485,144 B2
(45) Date of Patent: Nov. 1, 2022

(54) INKJET PRINTER, AND PRINTING METHOD

(71) Applicant: SEIKO EPSON CORPORATION, Tokyo (JP)

(72) Inventors: Kenji Otokita, Higashichikuma-gun (JP); Norihiro Masuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 64 days.

(21) Appl. No.: 17/083,913

(22) Filed: Oct. 29, 2020

(65) Prior Publication Data

US 2021/0129542 A1 May 6, 2021

(30) Foreign Application Priority Data

Oct. 30, 2019 (JP) ..... JP2019-197240

(51) Int. Cl.
*B41J 2/17* (2006.01)
*B41J 2/175* (2006.01)
*B41J 2/185* (2006.01)

(52) U.S. Cl.
CPC ..... *B41J 2/1714* (2013.01); *B41J 2/175* (2013.01); *B41J 2/1721* (2013.01); *B41J 2002/1853* (2013.01)

(58) Field of Classification Search
CPC ..... B41J 2/1714; B41J 2/1721; B41J 2/175; B41J 2002/1853; B41J 2002/1728; B41J 2/21; B41J 2/145
USPC ..... 347/34
See application file for complete search history.

(56) References Cited

U.S. PATENT DOCUMENTS 9,527,291 B2 12/2016 Shimizu
2007/0109348 A1* 5/2007 Izawa ..... B41J 2/1714 347/34
2013/0229458 A1* 9/2013 Masuda ..... B41J 11/00214 347/30
2014/0313259 A1* 10/2014 Arimizu ..... B41J 2/1721 347/34
2015/0145922 A1 5/2015 Masuda
2016/0031218 A1 2/2016 Ishida et al.
2017/0341399 A1* 11/2017 Arimizu ..... B41J 2/16517
(Continued)

FOREIGN PATENT DOCUMENTS

EP 3702161 9/2020
JP 2013-180539 A 9/2013
JP 2017-213714 A 12/2017

*Primary Examiner* — Kristal Feggins
*Assistant Examiner* — Alexander D Shenderov
(74) *Attorney, Agent, or Firm* — Workman Nydegger

(57) ABSTRACT

A printer includes a transport unit, a first head, a second head disposed downstream of the first head, a first suction unit configured to suction ink mist discharged from the first head, a second suction unit configured to suction ink mist discharged from the second head, and a suction device coupled to the first suction unit and the second suction unit, and configured to generate an airflow for suctioning the ink mist, and a first suction device disposed either one of on a first path from the first suction unit to the suction device, and at the suction device, and configured to adjust a flow rate at the first suction unit, and a second suction device disposed either one of on a second path from the second suction unit to the suction device, and at the suction device, and configured to adjust the flow rate at the second suction unit.

7 Claims, 13 Drawing Sheets

(56) References Cited

U.S. PATENT DOCUMENTS

| | | | | |
|---|---|---|---|---|
| 2020/0122468 | A1* | 4/2020 | Takahashi | B41J 2/1714 |
| 2020/0269585 | A1* | 8/2020 | Izawa | B41J 2/1714 |
| 2020/0307221 | A1* | 10/2020 | Masuda | B41J 11/00214 |
| 2020/0307284 | A1* | 10/2020 | Shimomura | B41J 2/1714 |

* cited by examiner

FIRST TABLE

| INK NAME | SET VALUE |
|---|---|
| YELLOW A | 2 |
| YELLOW B | 3 |
| MAGENTA A | 1 |
| MAGENTA B | 2 |
| CYAN | 1 |
| BLACK A | 2 |
| BLACK B | 2 |
| BLACK C | 1 |
| WHITE | 3 |
| OFF-WHITE | 2 |
| CLEAR | 3 |

FIG. 6

SECOND TABLE

| INK MIST-GENERATION DEGREE | LANDING POSITION DEVIATION -INFLUENCE DEGREE | SET VALUE |
|---|---|---|
| LARGE | LARGE | 1 |
| LARGE | MEDIUM | 3 |
| LARGE | SMALL | 3 |
| MEDIUM | LARGE | 2 |
| MEDIUM | MEDIUM | 2 |
| MEDIUM | SMALL | 2 |
| SMALL | LARGE | 1 |
| SMALL | MEDIUM | 1 |
| SMALL | SMALL | 1 |

FIG. 11

INKJET PRINTER, AND PRINTING METHOD

The present application is based on, and claims priority from JP Application Serial Number 2019-197240, filed Oct. 30, 2019, the disclosure of which is hereby incorporated by reference herein in its entirety.

BACKGROUND

1. Technical Field

The present disclosure relates to an inkjet printer and a printing method.

2. Related Art

There has been known an inkjet printer configured to print an image or character on a medium while causing a head of a line type configured to discharge ink to move relative to a recording medium. As an example of the inkjet printer, JP 2013-180539 A discloses a liquid discharge device that includes a plurality of discharge heads configured to discharge a liquid, and a plurality of suction containers for suctioning mist generated at each of the discharge heads, a collection container communicating with the plurality of suction containers and being configured to collect the mist, and a suction device configured to generate an airflow from the plurality of suction containers to the collection container.

The inkjet printer of JP 2013-180539 A causes a one piece of the suction device to generate an airflow for suctioning the mist in the suction container provided in each of the discharge heads. A generated amount of the mist varies depending on a type of ink, and an influence on an image quality when a landing position deviation occurs due to the airflow for suctioning the mist also varies depending on the type of ink. Thus, the inkjet printer of JP 2013-180539 A has room to improve an image quality by individually controlling a suction amount depending on the type of ink.

SUMMARY

An inkjet printer includes a transport unit configured to transport a recording medium in a transport direction, a first head having a nozzle row including a plurality of nozzles aligned in a direction intersecting the transport direction, the first head being configured to discharge a first ink in droplets from the nozzle row onto the recording medium, a second head disposed downstream of the first head in the transport direction and having a nozzle row including a plurality of nozzles aligned in the direction intersecting the transport direction, the second head being configured to discharge a second ink in droplets from the nozzle row onto the recording medium, a first suction unit disposed between the first head and the second head in the transport direction, the first suction unit being configured to suction ink mist generated when the first ink is discharged from the first head, a second suction unit disposed downstream of the second head in the transport direction, the second suction unit being configured to suction ink mist generated when the second ink is discharged from the second head, a suction device coupled to the first suction unit and the second suction unit, the suction device being configured to generate an airflow for suctioning the ink mist at the first suction unit and the second suction unit, a first adjustment unit disposed either one of on a first path being a path of an airflow flowing from the first suction unit to the suction device, and at the suction device, the first adjustment unit being configured to adjust a flow rate of an airflow passing through the first suction unit per unit time, a second adjustment unit disposed either one of on a second path being a path of an airflow flowing from the second suction unit to the suction device, and at the suction device, the second adjustment unit being configured to adjust a flow rate of an airflow passing through the second suction unit per unit time.

The inkjet printer described above may include a control unit configured to control the first adjustment unit and the second adjustment unit, and a storage unit configured to store a first setting value for adjusting the first adjustment unit and a second setting value for adjusting the second adjustment unit, in which the control unit may be configured to control the first adjustment unit based on the first setting value, and may be configured to control the second adjustment unit based on the second setting value.

The inkjet printer described above may include an input unit to which ink information is input, in which the storage unit may be configured to store a table indicating a correspondence of the ink information including ink information of the first ink and ink information of the second ink, and the flow rate or setting values which includes the first setting value and the second setting value, and the control unit may be configured to cause the storage unit to store the first setting value and the second setting value, based on the ink information input from the input unit, and the table.

In the inkjet printer described above, the input unit may be configured to accept an input of the flow rate corresponding to the ink information, or the setting values, and the control unit may be configured, when the table does not include correspondence information between the ink information input from the input unit, and the flow rate or the setting value, to update the table to add, to the table, the correspondence information between the ink information, and the flow rate or the setting value.

In the inkjet printer described above, the ink information may include an ink mist-generation degree and either one of an ink color or a landing position deviation-influence degree.

A printing method is a printing method using an inkjet printer, the inkjet printer including a transport unit configured to transport a recording medium in a transport direction, a first head having a nozzle row including a plurality of nozzles aligned in a direction intersecting the transport direction, the first head being configured to discharge a first ink in droplets from the nozzle row onto the recording medium, a second head disposed downstream of the first head in the transport direction and having a nozzle row including a plurality of nozzles aligned in the direction intersecting the transport direction, the second head being configured to discharge a second ink in droplets from the nozzle row onto the recording medium, a first suction unit disposed between the first head and the second head in the transport direction, the first suction unit being configured to suction ink mist generated when the first ink is discharged from the first head, a second suction unit disposed downstream of the second head in the transport direction, the second suction unit being configured to suction ink mist generated when the second ink is discharged from the second head, a suction device coupled to the first suction unit and the second suction unit, the suction device being configured to generate an airflow for suctioning the ink mist at the first suction unit and the second suction unit, a first adjustment unit disposed either one of on a first path being a path of an airflow flowing from the first suction unit to the suction device, and at the suction device, the first adjustment unit being configured to adjust a flow rate of the airflow passing through the first suction unit per unit time, a second adjustment unit disposed either one of on a second path being a path of an airflow flowing from the second suction unit to the suction device, and at the suction device, the second adjustment unit being configured to adjust a flow rate of an airflow passing through the second suction unit per unit time, and a storage unit configured to store a first setting value for adjusting the first adjustment unit and a second setting value for adjusting the second adjustment unit, and a table indicating a correspondence of ink information including ink information of the first ink and ink information of the second ink, and the flow rate or setting values which includes the first setting value and the second setting value, the printing method including a setting value determination step for determining the first setting value and the second setting value with reference to the table, and a flow rate adjustment step for adjusting the first adjustment unit based on the first setting value, and adjusting the second adjustment unit based on the second setting value.

The printing method described above may include an ink information acquisition step for acquiring the ink information before the setting value determination step, and determining, in the setting value determination step, the first setting value and the second setting value based on the ink information acquired in the ink information acquisition step and the table.

The printing method described above may include a table update step for adding correspondence information between the ink information acquired in the ink information acquisition step, and the flow rate or the setting values to the table when the table does not contain the correspondence information between the ink information, and the flow rate or the setting value.

In the printing method described above, the ink information may include an ink mist-generation degree and either one of an ink color and a landing position deviation-influence degree, the printing method including an ink information input step for determining the ink mist-generation degree and inputting the ink information including the ink mist-generation degree being determined is included before the ink information acquisition step, in which a length of a tailing of the droplet discharged from the nozzle may be measured to determine the ink mist-generation degree.

BRIEF DESCRIPTION OF THE DRAWINGS

FIG. 6 is a diagram illustrating a first table indicating a correspondence of an ink name and a setting value.

FIG. 11 is an explanatory diagram illustrating a second table indicating a correspondence of an ink mist-generation degree and a landing position deviation-influence degree, and a setting value.

DESCRIPTION OF EXEMPLARY EMBODIMENTS

1. Embodiment 1

1-1. Configuration of Printer

Figure 1:
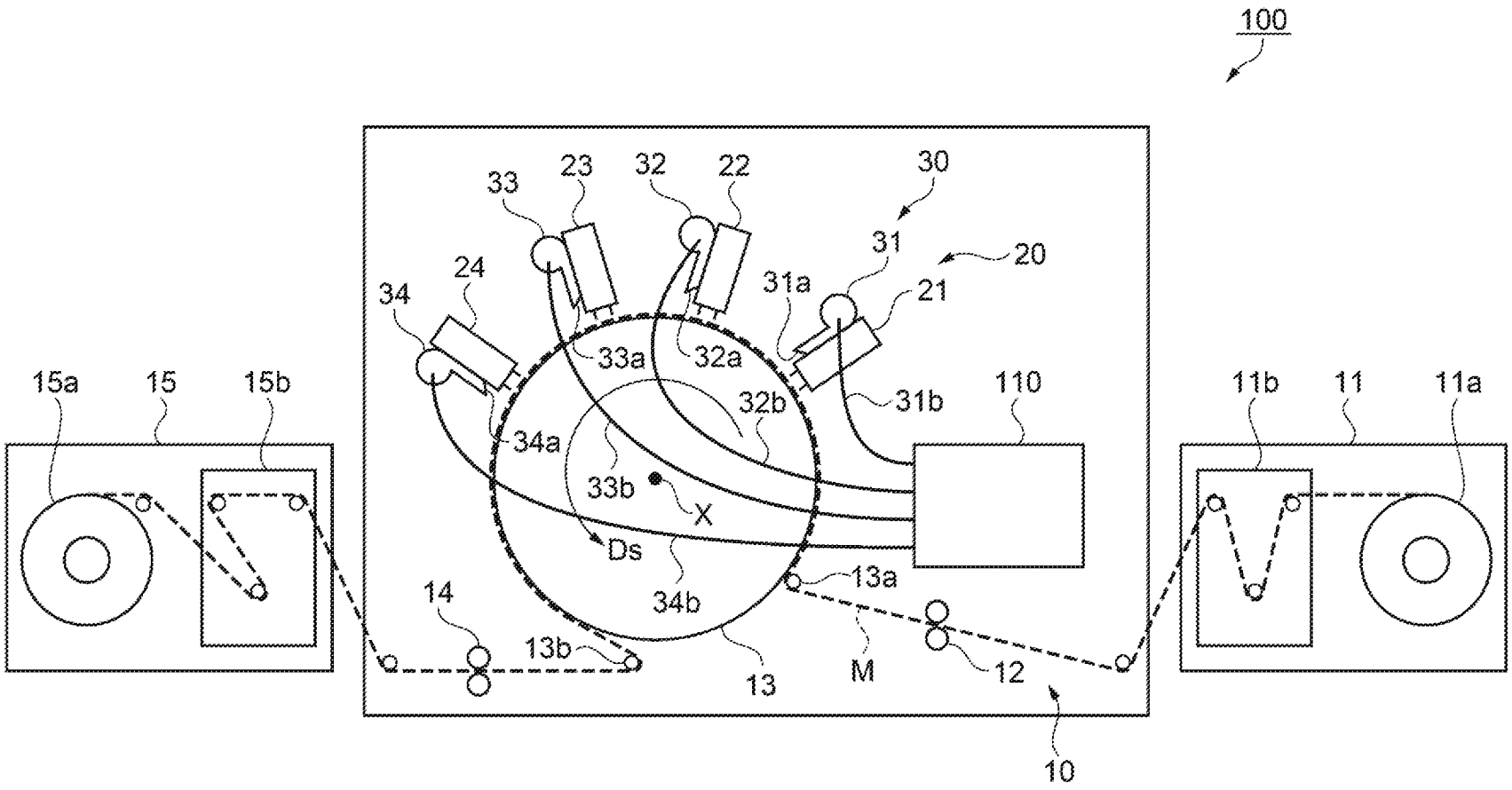
FIG. 1 is a side face view illustrating a schematic configuration of an inkjet printer according to Embodiment 1.
Figure 2:
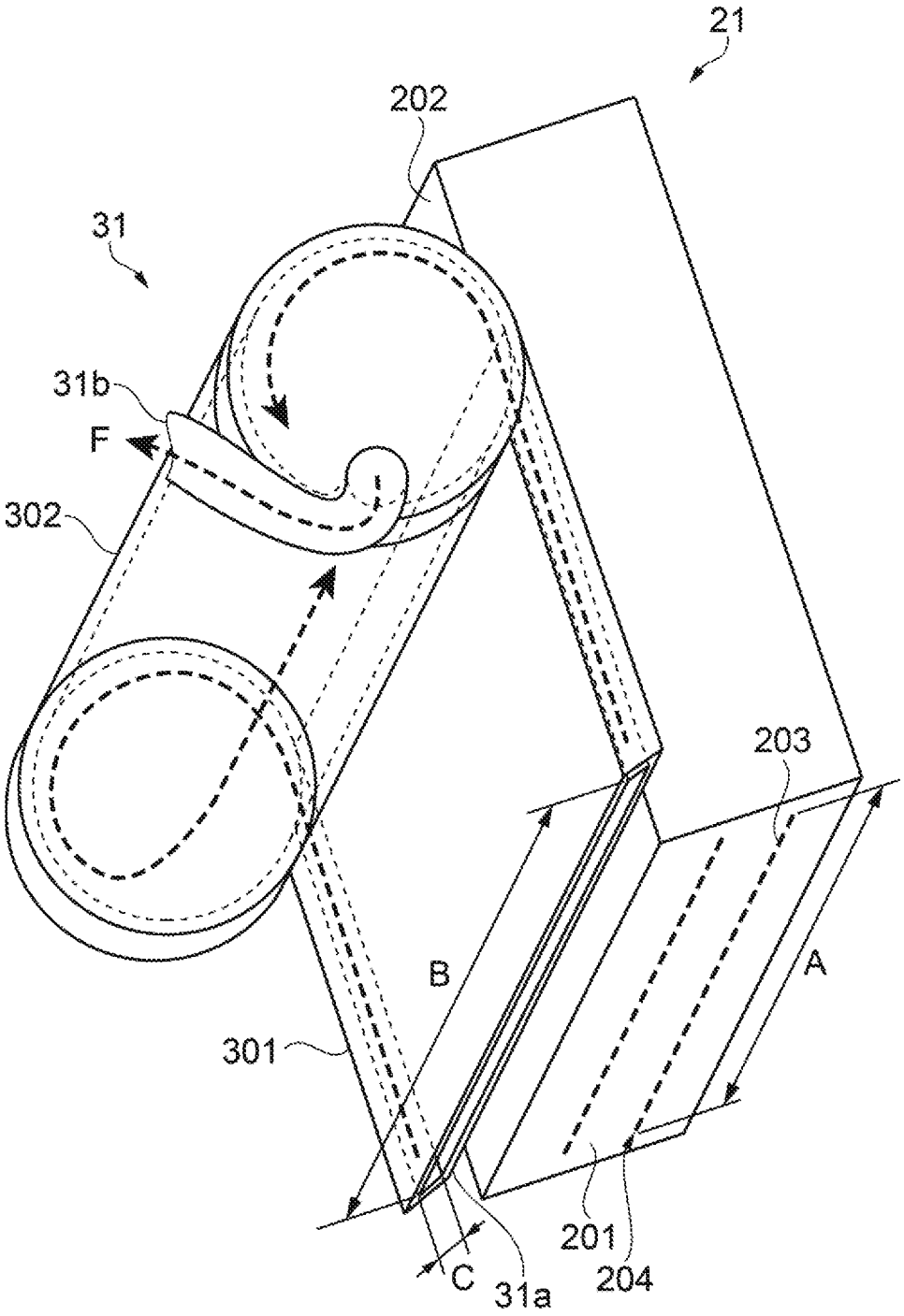
FIG. 2 is an enlarged perspective view illustrating a first head and a first suction unit.

FIG. 1 is a side face view illustrating a schematic configuration of an inkjet printer according to Embodiment 1. FIG. 2 is an enlarged perspective view illustrating a first head and a first suction unit. In the following descriptions, the inkjet printer is described as a printer 100. In addition, a positional relationship along a transport direction Ds of a recording medium M is also referred to as "upstream" or "downstream".

As illustrated in FIG. 1, the printer 100 includes a transport unit 10 configured to transport the recording medium M in the transport direction Ds, and a printing unit 20 configured to discharge droplets onto the recording medium M. The transport unit 10 includes a supply unit 11, a front driving roller pair 12, a drum 13, a rear driving roller pair 14, and a recovery unit 15.

The supply unit 11 includes a feed reel 11*a* and a tension adjuster 11*b*. The recording medium M is wound in a rolled form around a winding core of the feed reel 11*a*, where the feed reel 11*a* rotates about a central axis of the winding core, thus feeding out the recording medium M toward the drum 13. The tension adjuster 11*b* includes a roller that is biased to apply a predetermined tension to the recording medium paper M between the feed reel 11*a* and the printing unit 20.

The recording medium M fed out from the supply unit 11 is supplied, via an introduction roller 13*a*, to the drum 13, to be fed, via a derivation roller 13*b*, to the recovery unit 15. The drum 13 is formed in a columnar or elliptic columnar shape, and is rotatably supported about a central axis X. The introduction roller 13*a* is a roller that introduces the recording medium M supplied from the supply unit 11 in a tangential direction of the side face with respect to the drum 13. The derivation roller 13*b* is a roller that derives the recording medium M held on an outer circumferential surface of the drum 13 in the tangential direction of the side face of the drum 13.

The recovery unit 15 includes a collection reel 15*a* and a tension adjuster 15*b*. The recording medium M is wound around a winding core of the collection reel 15*a*, where the collection reel 15*a* rotates about a central axis of the winding core, thus winding the recording medium M into a rolled form. The tension adjuster 15*b* includes a roller that is biased to apply a predetermined tension to the recording medium M between the collection reel 15*a* and the printing unit 20.

The front driving roller pair 12, which is provided between the supply unit 11 and the introduction roller 13*a*, clamps the recording medium M. The front driving roller pair 12 then drives to rotate, to cause the recording medium M fed out from the supply unit 11 to be transported toward the drum 13.

The rear driving roller pair 14, which is provided between the derivation roller 13*b* and the recovery unit 15, clamps the recording medium M. The rear driving roller pair 14 then drives to rotate, to cause the recording medium M derived from the drum 13 to be transported toward the recovery unit 15.

The drum 13 is driven to rotate in conjunction with the transport of the recording medium M, while supporting, from the back face, the recording medium M being transported from the front driving roller pair 12 to the rear driving roller pair 14. This allows the recording medium M supported on the outer circumferential surface of the drum 13 to be transported in the transport direction Ds.

The printing unit 20 is constituted by a plurality of heads provided along the outer circumferential surface of the drum 13. The printing unit 20 of Embodiment 1 exemplifies a configuration in which a first head 21, a second head 22, a third head 23, and a fourth head 24 are provided. The heads 21 to 24 are each disposed facing a surface of the recording medium M supported by the drum 13, creating a slight gap in between. In the transport direction Ds, the second head 22 is disposed downstream of the first head 21, the third head 23 is disposed downstream of the second head 22, and the fourth head 24 is disposed downstream of the third head 23.

As illustrated in FIG. 2, the heads 21 to 24 each include a nozzle face 201 having a nozzle row 204 including a plurality of nozzles 203 aligned in a direction intersecting the transport direction Ds. The nozzle face 201 faces the recording medium M supported on the outer circumferential surface of the drum 13. In Embodiment 1, the nozzle face 201 has two rows of the nozzle rows 204, where a length A of the nozzle row 204 is longer than a width of the recording medium M, which is usable in the printer 100. The first head 21 is configured to discharge a first ink in droplets from the nozzle row 204 of the first head 21 toward the recording medium M. The second head 22 is configured to discharge a second ink in droplets from the nozzle row 204 of the second head 22 toward the recording medium M. The third head 23 is configured to discharge a third ink in droplets from the nozzle row 204 of the third head 23 toward the recording medium M. The fourth head 24 is configured to discharge a fourth ink in droplets from the nozzle row 204 of the fourth head 24 toward the recording medium M. The first to fourth inks are selected from several types of inks such as cyan, magenta, yellow, black, white, clear, and the like. Note that, in Embodiment 1, the printing unit 20 constituted by four pieces of the heads 21 to 24 is exemplified, and a printing unit constituted by three or fewer heads, or a printing unit constituted by five or more heads may also be used.

1-2. Configuration of Mist Collection Device

Figure 3:
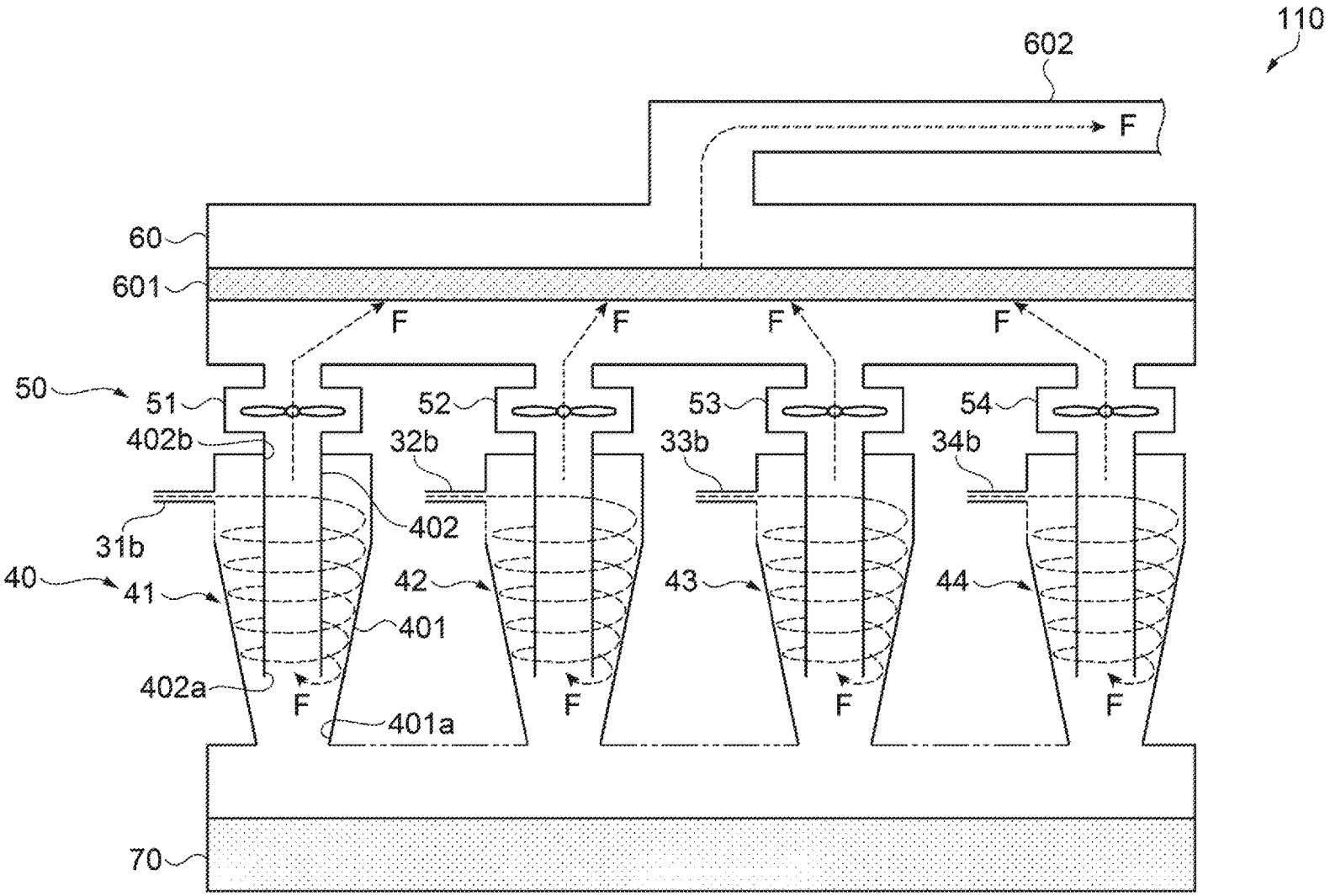
FIG. 3 is a conceptual view illustrating a configuration of a mist collection section.

FIG. 3 is a conceptual view illustrating a configuration of a mist collection section.

The printer 100 includes a mist collection mechanism configured to collect mist generated in conjunction with discharging the ink. The mist collection mechanism is constituted by a suction unit 30 and a mist collection section 110. As illustrated in FIG. 3, the mist collection section 110 includes a cyclone 40, a suction device 50, a filter section 60, a liquid recovery unit 70, and the like.

As illustrated in FIG. 1, the suction unit 30 is constituted by first to fourth suction units 31, 32, 33, and 34. Note that configurations of the second suction unit 32, the third suction unit 33, and the fourth suction unit 34 are the same as a configuration of the first suction unit 31, and thus descriptions of these units will be omitted.

The first suction unit 31 is disposed between the first head 21 and the second head 22 in the transport direction Ds, and is configured to suction ink mist generated when the first ink is discharged from the first head 21. The first suction unit 31 has a first suction port 31*a* through which the ink mist is suctioned. The first suction unit 31 is coupled to a first path being a path of an airflow flowing from the first suction unit 31 to the suction device 50, and is configured to suction the ink mist together with the airflow. The first path includes the cyclone 40, a suction unit 301 described later, a hollow member 302, and a first flow path 31*b*.

As illustrated in FIG. 2, the first suction unit 31 is located adjacent to a vertical wall face 202 located downstream in the transport direction Ds of the first head 21.

The first suction unit 31 includes the suction unit 301 and the hollow member 302. The suction unit 301 is formed in a hollow shape with a constant cross-section when cut parallel to the nozzle face 201, and a dimension B in an alignment direction in which the nozzles 203 are aligned is longer than the length A of the nozzle row 204. Further, a dimension C in an orthogonal direction orthogonal to the alignment direction in which the nozzles 203 are aligned of an internal space of the suction unit 301 is less than a dimension in an alignment direction of the nozzle row 204, where the internal space of the suction unit 301 has a long and thin shape that is elongated in a direction of the nozzle row. At each of an upper end and lower end of the suction unit 301, an opening having a long and thin shape is formed, which is elongated in the alignment direction in which the nozzles 203 are aligned, and the opening at the lower end constitutes the first suction port 31*a*. In the internal space of the suction unit 301, air flows through the first suction port 31*a* toward the upper end. A direction of the airflow in the internal space of the suction unit 301 coincides with a direction opposite to a discharge direction in which the ink is discharged in the first head 21. Note that a flow of the airflow is schematically indicated by an arrow F of a bold line.

The hollow member 302 is formed in a cylindrical shape having a central axis being parallel to the alignment direction in which the nozzles 203 are aligned. The upper end of the suction unit 301 is coupled to the hollow member 302 such that the direction of the airflow in the internal space of the suction unit 301 becomes parallel to the discharge direction in which the ink is discharged in the first head 21. Thus, the airflow is introduced, via the opening at the upper end of the suction unit 301, in a direction parallel to the discharge direction in which the ink is discharged. One side face of the hollow member 302 is coupled to the first flow path 31*b*. This allows airflow F flowing in through the first suction port 31*a* flows outward, via the suction unit 301 and the hollow member 302, through the first flow path 31*b*.

As illustrated in FIG. 3, the cyclone 40 is constituted by first to fourth cyclones 41, 42, 43, and 44. The suction device 50 is constituted by first to fourth suction devices 51, 52, 53, and 54. The first flow path 31*b* is coupled, via the first cyclone 41, to the first suction device 51.

The first flow path 31*b*, which is a tube having a circular cross section, communicates the first suction unit 31 with the first suction device 51. This allows the first suction device 51 to be coupled to the first suction unit 31, thus generating airflow for suctioning ink mist in the first suction unit 31. The first suction device 51 also functions as a first adjustment unit configured to adjust a flow rate of an airflow passing through the first suction unit 31 per unit time.

Configurations of a second flow path 32*b*, third flow path 33*b*, and fourth flow path 34*b* are the same as a configuration of the first flow path 31*b*, and thus descriptions of these flow paths will be omitted.

As described above, the first to fourth adjustment units are the first to fourth suction devices 51, 52, 53, and 54, as well as the suction device 50. In other words, the first to fourth adjustment units can also be regarded as being disposed at the suction device 50.

A configuration of the mist collection section 110 including the first cyclone 41 and the first suction device 51 will be described with reference to FIG. 3. Note that configurations of the second to fourth cyclones 42, 43, and 44 and the second to fourth suction devices 52, 53, and 54 are the same as configurations of the first cyclone 41 and the first suction device 51, and thus descriptions of these components will be omitted.

The first cyclone 41 has a cyclone housing 401 in a substantially circular truncated cone shape that decreases in diameter as approaching downward in a vertical direction, where the first flow path 31*b* is coupled to an upper portion in the vertical direction of the cyclone housing 401. Moreover, the first cyclone 41 has a cyclone muffler 402 in a columnar shape, which extends in the vertical direction. The cyclone muffler 402 is formed hollow, where an upper end opening 402*b* of the cyclone muffler 402 protrudes upward from the cyclone housing 401 while a lower end opening 402*a* of the cyclone muffler 402 is located in the vertical direction below a coupling portion of the first flow path 31*b*.

The mist collection section 110 includes the first suction device 51 coupled to the upper end opening 402*b* of the cyclone muffler 402 of the first cyclone 41. The first suction device 51 serves as a so-called blower, where the lower end opening of the first suction device 51 is coupled to the upper end opening 402*b* of the cyclone muffler 402. The blower as the first suction device 51 rotates to generate the airflow F indicated by dashed arrows in FIGS. 2 and 3.

The mist collection section 110 includes the filter section 60 coupled to an upper end opening of the first suction device 51. The filter section 60, which is formed in a substantially columnar shape extending in the vertical direction, houses a filter 601 disposed is close contact with an inner wall of the filter section 60. This allows an interior portion of the filter section 60 to be sectioned into a side of the first suction device 51 with respect to the filter 601 and an opposite side of the filter 601 from the first suction device 51. At the opposite side from the first suction device 51 in the interior portion of the filter section 60 is provided with an exhaust duct 602 configured to discharge, to the outside, the airflow F having passed through the filter 601.

Specifically, the airflow F, when entering into the cyclone housing 401 of the first cyclone 41 through the first flow path 31*b*, moves downward in a spiral manner while swirling around the cyclone muffler 402, between an inner wall of the cyclone housing 401 and an outer wall of the cyclone muffler 402. The airflow F having reached the lower end opening 402*a* of the cyclone muffler 402 then moves upward inside the cyclone muffler 402 to reach the filter section 60 via the first suction device 51. The airflow F further moves upward inside the filter section 60, passes through the filter 601, and exits outside through the exhaust duct 602.

Then, gas containing the ink mist is caused to move along the airflow F thus moving, to thus separate the ink mist from the gas. That is, the ink mist contained in the gas is driven outward by a centrifugal force generated when swirling with the airflow F inside the cyclone housing 401, to adhere to the inner wall of the cyclone housing 401. In this way, the ink mist is separated by centrifugation from the gas. Moreover, the gas from which the ink mist is separated by centrifugation passes through the filter 601. At this time, a fractional ink mist that has not been removed by centrifugation is trapped by the filter 601 to be separated from the gas as well. This allows clean gas from which the ink has been removed with high efficiency to exit outside through the exhaust duct 602.

The mist collection section 110 also includes the liquid recovery unit 70 configured to discharge, to the outside, the ink separated by centrifugation by the first cyclone 41. The liquid recovery unit 70, which is coupled to a lower end opening 401*a* of the cyclone housing 401, accumulates the ink having fallen down along the inner wall of the cyclone housing 401.

Figure 4:
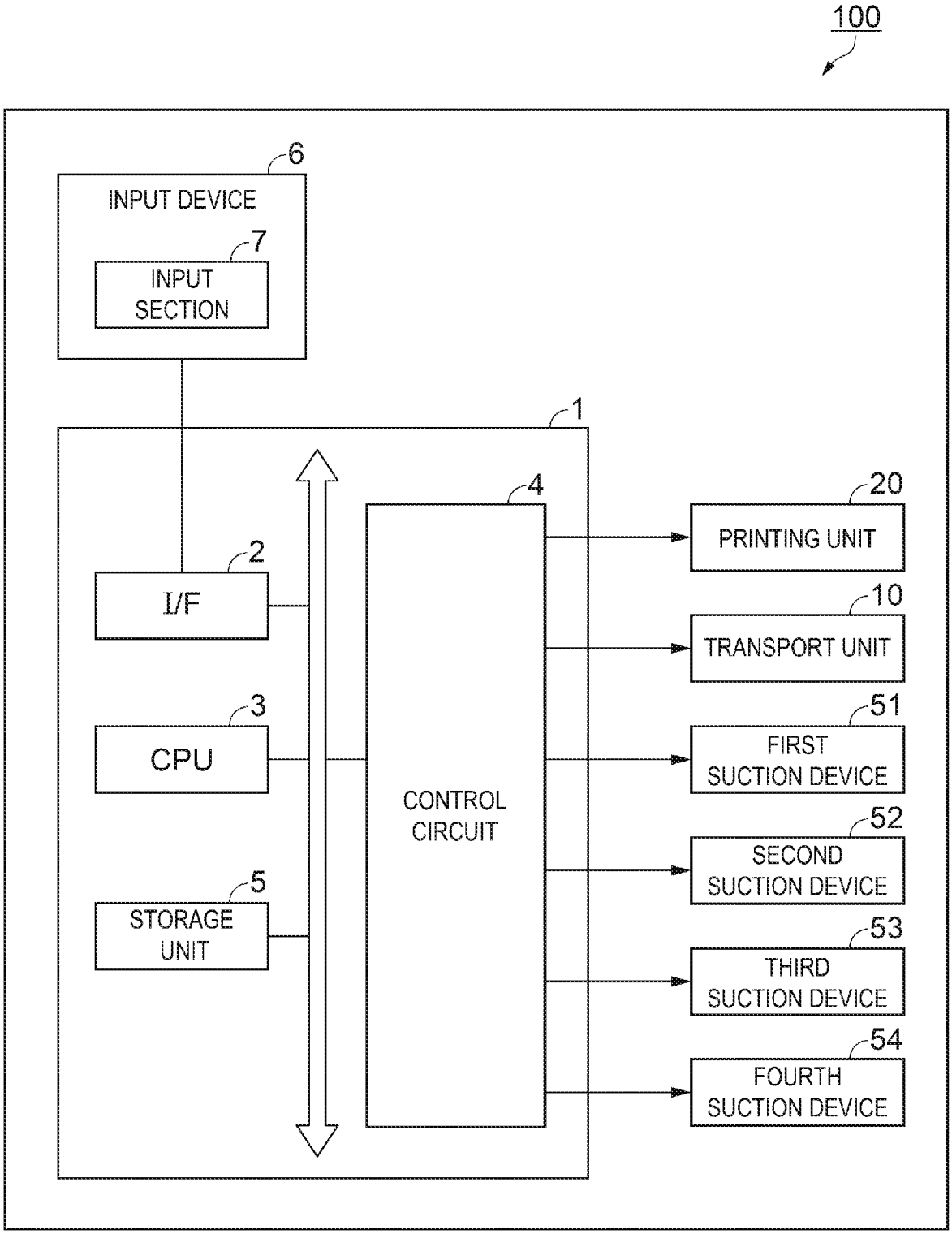
FIG. 4 is a block diagram schematically illustrating an electrical coupling of an inkjet printer.

FIG. 4 is a block diagram schematically illustrating an electrical coupling of an inkjet printer. Next, an electrical configuration of the printer 100 will be described with reference to FIG. 4.

The printer 100 includes a control unit 1 configured to control the respective components included in the printer 100. The control unit 1 is configured to include an interface (I/F) unit 2, a Central Processing Unit (CPU) 3, a control circuit 4, a storage unit 5, and the like. The CPU 3 is coupled, via a bus, to the respective components.

The I/F unit 2, which is coupled to an input device 6 that handles input signals and images and configured to send/receive data between the input device 6 and the control unit 1, receives print data and the like generated in the input device 6. The input device 6 is constituted by a computer and the like.

The CPU 3 serves as an arithmetic processing device for performing various input signal processings, and an overall control of the printer 100 in accordance with programs stored in the storage unit 5 and the print data received from the input device 6.

The storage unit 5, which serves as a recording medium for ensuring an area for storing the programs, a work area, and the like of the CPU 3, includes a storage device such as a Random Access Memory (RAM) or an Electrically Erasable Programmable Read Only Memory (EEPROM). The storage unit 5 also includes an area for storing a first setting value for adjusting the first suction device 51 and a second setting value for adjusting the second suction device 52. Similarly, the storage unit 5 includes an area for storing a third setting value for adjusting the third suction device 53 and a fourth setting value for adjusting the fourth suction device 54. The storage unit 5 is also configured to store various tables for determining the first to fourth setting values.

The control circuit 4 is coupled to the printing unit 20 and the transport unit 10, and is configured to generate control signals for controlling driving of the printing unit 20 and the transport unit 10 based on the print data and arithmetic results of the CPU 3.

The control circuit 4 is also coupled to the first to fourth suction devices 51, 52, 53, and 54, and is configured to generate control signals for controlling driving of the first to fourth suction devices 51, 52, 53, and 54 based on commands from the CPU 3. That is, the control unit 1 is configured to control the first to fourth suction devices 51, 52, 53, and 54 based on the first to fourth setting values stored in the storage unit 5.

The input device 6 includes an input unit 7. Specifically, the input unit 7 is composed of a keyboard, a mouse, a touch panel, and the like, and to which ink information of the first to fourth inks discharged from the first to fourth heads 21, 22, 23, and 24 is input.

The control unit 1 is configured to generate head control signals for controlling driving of the first to fourth heads 21, 22, 23, and 24 constituting the printing unit 20, and to perform an image forming operation in which the first to fourth inks are discharged from the respective heads 21, 22, 23, 24 to discharge droplets onto the recording medium M. The control unit 1 is configured to generate transport control signals for controlling driving of the front driving roller pair 12 and the rear driving roller pair 14 of the transport unit 10 to perform transport operation of transporting the recording medium M in the transport direction Ds. The control unit 1 causes the transport operation and the image forming operation to be alternately performed, to thus print a desired image based on image data on the recording medium M.

1-3. Printing Method 1

Figure 5:
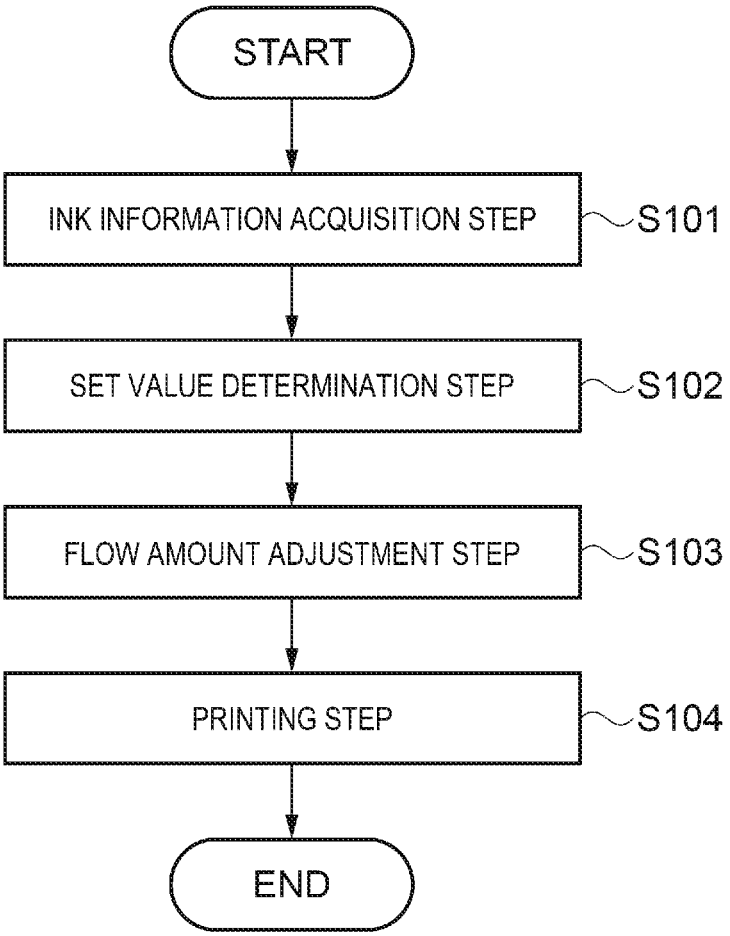
FIG. 5 is an explanatory flowchart illustrating a printing method 1.
Figure 7:
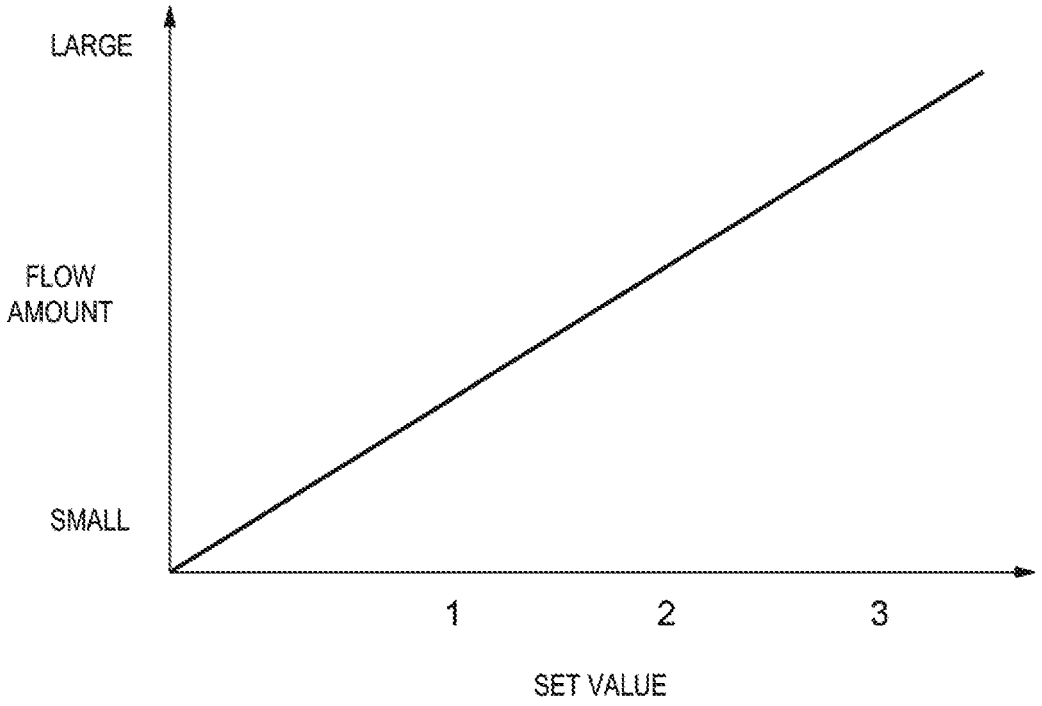
FIG. 7 is a graph illustrating a relationship between a setting value and a flow rate.
Figure 8:
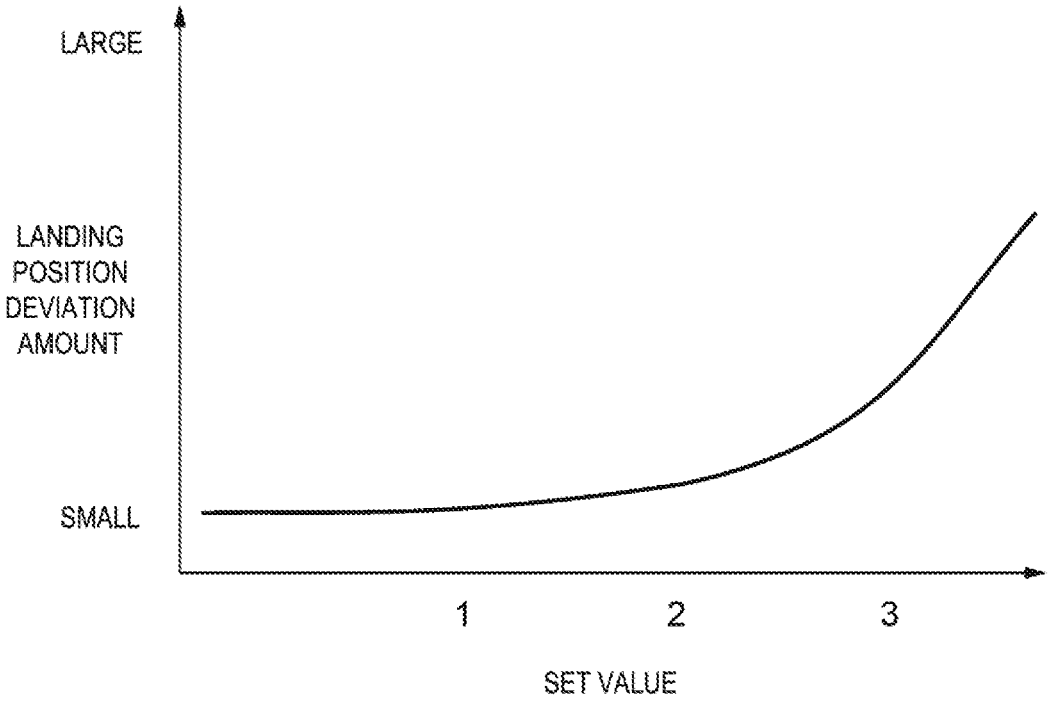
FIG. 8 is a graph illustrating a relationship between a setting value and a landing position deviation amount.

FIG. 5 is an explanatory flowchart illustrating a printing method 1 for the inkjet printer. FIG. 6 is a diagram illustrating a first table illustrating a correspondence of an ink name and the setting value. FIG. 7 is a graph illustrating a relationship between the setting value and the flow rate. FIG. 8 is a graph illustrating a relationship between the setting value and a landing position deviation amount.

Step S101 is an ink information acquisition step for acquiring ink information for specifying inks used as the first to fourth inks. The control unit 1 acquires the ink information that is input, via the I/F unit 2, from the input unit 7 of the input device 6. The ink information includes the ink name, an ink color, and the like for specifying the type of the ink.

Step S102 is a setting value determination step for determining the first to fourth setting values with reference to the first table. The storage unit 5 stores the first table indicating a correspondence of the ink information and the setting value. As illustrated in FIG. 6, in the first table, there is written the correspondence of the ink name as the ink information and the setting value. The setting value, which contains a voltage value or rotational speed for driving the first to fourth suction devices 51, 52, 53, and 54, is set in three stages from "1" to "3" in Embodiment 1. A graph in FIG. 7 illustrates a relationship between the setting value and a flow rate of the airflow for suctioning the ink mist. For example, changing the setting value of the first suction device 51 from 1 to 3 allows the flow rate of the airflow passing through the first suction unit 31 to increase in proportion to the setting value. Thus, the first table may be a table indicating a correspondence of the ink information and the flow rate of the airflow.

FIG. 8 illustrates a relationship between the setting value, that is, the flow rate of the airflow, and the landing position deviation amount when the droplet of the ink lands on the recording medium M. When the flow rate of the airflow for suctioning the ink mist is increased, the landing position deviation amount increases in an accelerated manner. A landing position deviation-influence degree that the landing position deviation amount has an effect on the print quality varies depending on the ink color. For example, even when the amounts of landing position deviation are the same as each other, a landing position deviation of a white or yellow ink is hard to be visually recognized, while the landing position deviation of the black is easy to be visually recognized. Thus, an acceptable value for the landing position deviation amount differs depending on the ink color. The setting value is determined in consideration of an ink mist-generation amount generated when discharging inks from the nozzles 203 added to the landing position deviation-influence degree determined by the ink color. In the first table, the setting value is pre-registered as to the ink that is usable at the time when the printer 100 is shipped.

The control unit 1 determines the first to fourth setting values for controlling the first to fourth suction devices 51, 52, 53, and 54 based on the ink information of the first to fourth inks acquired in the step S101 and the first table stored in the storage unit 5. For example, the control unit 1, when the ink information of the first ink contains the ink name of "Magenta B", determines the first setting value for driving the first suction device 51 as "2" with reference to the first table. The control unit 1 then causes the first to fourth setting values having been determined to be stored in a predetermined storage area of the storage unit 5.

Step S103 is a flow rate adjustment step for adjusting the first to fourth suction devices 51, 52, 53, and 54 based on the first to fourth setting values. The control unit 1 references the first to fourth setting values stored in the storage unit 5 to control the first to fourth suction devices 51, 52, 53, and 54. This regulates the flow rate of the gas that is suctioned through the first suction port 31*a* and second to fourth suction ports 32*a*, 33*a*, and 34*a*.

Step S104 is a printing step for performing printing. The control unit 1 controls driving of the first to fourth heads 21, 22, 23, and 24 that constitute the printing unit 20 and the transport unit 10 based on the print data, to thus perform printing on the recording medium M. At this time, the ink mist generated when the first ink is discharged from the first head 21 is suctioned through the first suction port 31*a*. The ink mist generated when the second ink is discharged from the second head 22 is suctioned through the second suction port 32*a*. The ink mist generated when the third ink is discharged from the third head 23 is suctioned through the third suction port 33*a*. The ink mist generated when the fourth ink is discharged from the fourth head 24 is suctioned through the fourth suction port 34*a*.

1-4. Printing Method 2

Figure 9:
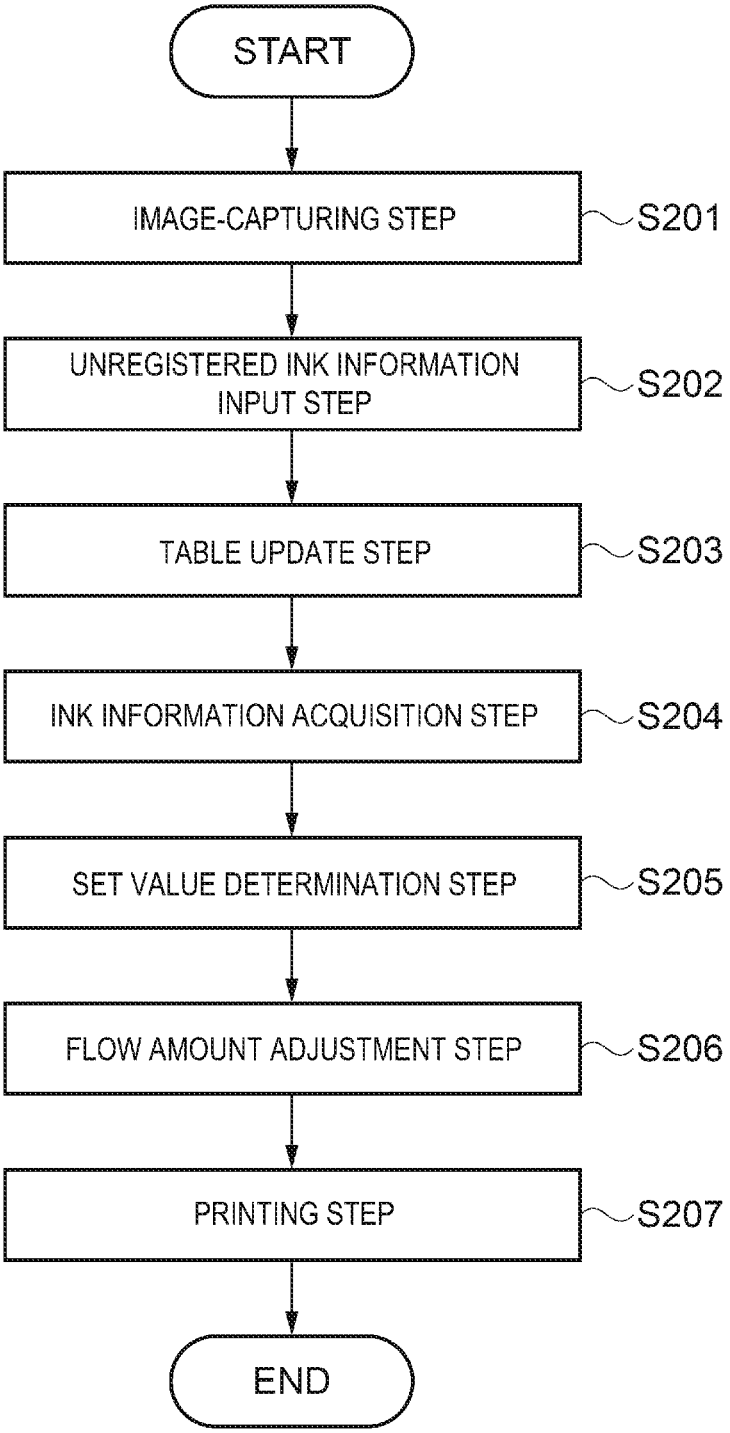
FIG. 9 is an explanatory flowchart diagram illustrating a printing method 2 for an inkjet printer.
Figure 10:
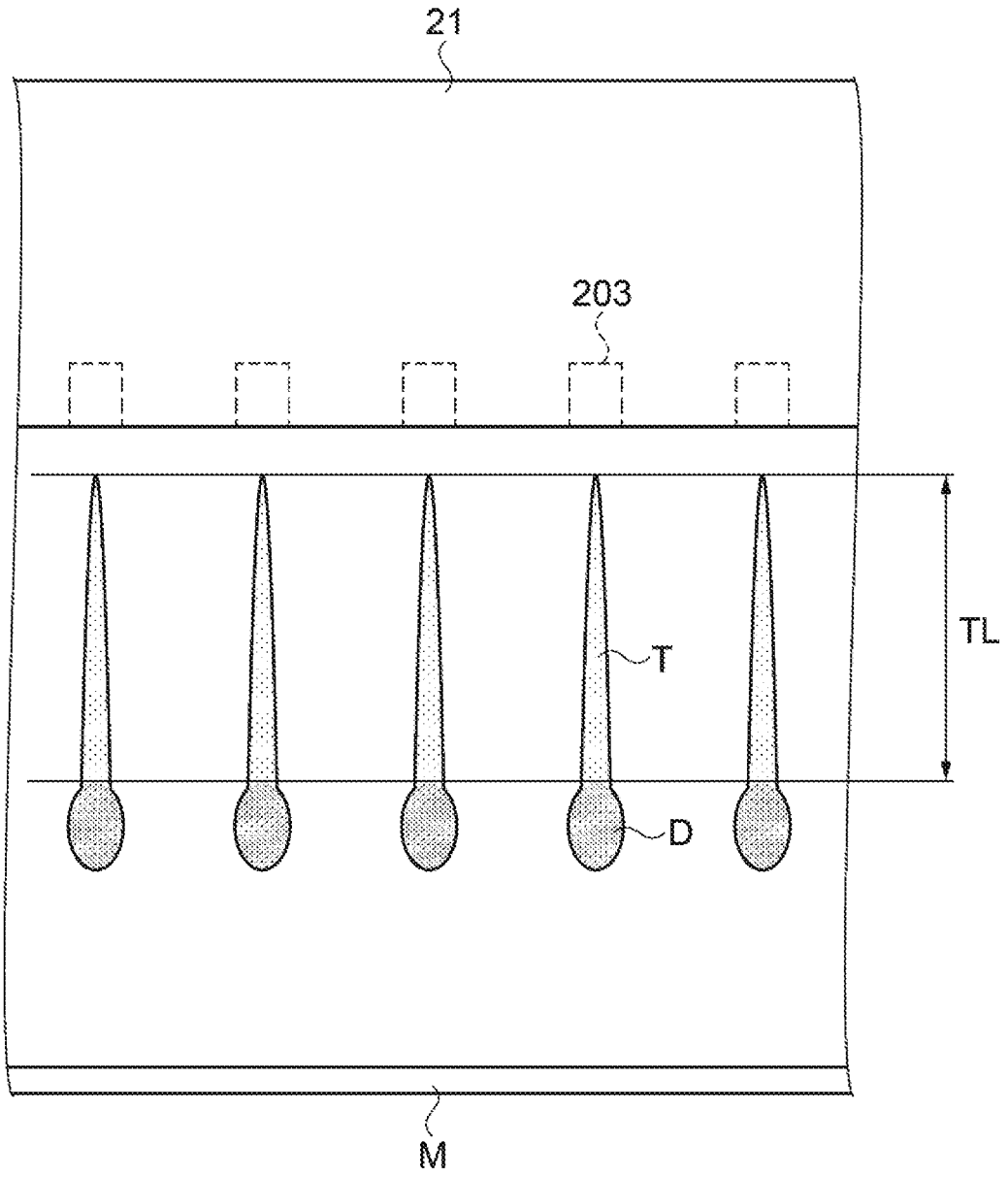
FIG. 10 is an explanatory view illustrating a tailing amount of a droplet.

FIG. 9 is an explanatory flowchart diagram illustrating a printing method 2 for an inkjet printer. FIG. 10 is an explanatory diagram illustrating a tailing amount of a droplet. FIG. 11 is an explanatory view illustrating a second table indicating a correspondence of an ink mist-generation degree and the landing position deviation-influence degree, and the setting value. The printing method 2 is a printing method when the first table does not contain correspondence information between the ink information acquired in the ink information acquisition step and the setting value, that is, when using ink that is not registered in the first table. Note that, in the following descriptions, the ink that is not registered in the first table is referred to as unregistered ink. In addition, steps S204 to S207 in the printing method 2 are the same as the steps S101 to S104 described in the printing method 1, and thus descriptions of these steps will be omitted.

Step S201 is an image-capturing step for image-capturing the droplets of the ink discharged from the nozzles 203 to determine the ink mist-generation degree. A user performs the image-capturing step when using the unregistered ink. For example, when the user image-captures, by a strobe camera, the droplets of the first ink discharged from the nozzles 203 of the first head 21, tailings T of droplets D are image-captured, as illustrated in FIG. 10.

Step S202 is an unregistered ink information input step for determining the ink mist-generation degree and inputting unregistered ink information including the ink mist-generation degree being determined. The ink mist-generation degree represents a rank that is classified according to the ink mist-generation amount generated when the droplets are discharged from the nozzles 203, and is classified into three stages, which are "large", "medium", and "small", for example. The ink mist-generation amount is in proportion to a tailing length TL, which is a length of the tailing T measured from the captured image that is image-captured in the image-capturing step of the step S201. The user inputs, into the input unit 7, the unregistered ink information including the ink name of the unregistered ink, either one of the ink color or the landing position deviation-influence degree, and the ink mist-generation degree.

Step S203 is a table update step for updating the first table, which contains the correspondence information between the ink information and the setting value. The storage unit 5 stores the second table indicating the correspondence of the ink mist-generation degree and the landing position deviation-influence degree, and the setting value. As illustrated in FIG. 11, in the second table, there is written the correspondence of the ink mist-generation degree and the landing position deviation-influence degree, and the setting value. The control unit 1 acquires the unregistered ink information that is input, via the I/F unit 2, from the input unit 7 of the input device 6. Then, the control unit 1, with reference to the second table, determines a setting value for driving the suction device 50 from the ink mist-generation degree of the unregistered ink and the landing position deviation-influence degree. The control unit 1 then adds the ink name of the unregistered ink and the setting value to the first table, to update the first table. As described above, the landing position deviation-influence degree represents a value that is determined for each of the ink colors, thus the setting value can be determined in a similar manner even when the acquired ink information includes the ink mist-generation degree and the ink color.

Note that, in the printing method 2, the description is given such that the control unit 1 determines the setting value of the unregistered ink to update the first table, however, the user may determine the setting value of the unregistered ink to update the first table based on the ink name as ink information of the unregistered ink that is input and the setting value.

Note that, in Embodiment 1, the configuration is described in which the first suction device 51 as the first adjustment unit, the second suction device 52 as the second adjustment unit, the third suction device 53 as the third adjustment unit, and the fourth suction device 54 as the fourth adjustment unit are provided in the suction device 50, but the present disclosure is not limited to this. A configuration may also be employed in which the first to fourth suction devices are provided in the first to fourth suction units 31 to 34, and a configuration may also be employed in which the first to fourth suction devices are provided inside the first to fourth flow paths 31*b* to 34*b*.

Also, the setting values for controlling the first to fourth suction devices 51 to 54 are described as being set in three stages, however, the setting values may be set in two stages or in four or more stages.

As described above, according to the printer 100, the printing methods 1 and 2 for the printer 100 according to Embodiment 1, the following advantageous effects can be achieved.

The printer 100 includes the first to fourth suction devices 51, 52, 53, and 54 as the first to fourth adjustment units in the suction device 50. The first suction device 51 is configured to adjust a flow rate of an airflow for suctioning the ink mist of the first ink, and the second suction device 52 is configured to adjust a flow rate of an airflow for suctioning the ink mist of the second ink. Similarly, the third suction device 53 is configured to adjust a flow rate of an airflow for suctioning the ink mist of the third ink, and the fourth suction device 54 is configured to adjust a flow rate of an airflow for suctioning the ink mist of the fourth ink. This makes it possible to adjust the airflow for suctioning the ink mist to an appropriate flow rate depending on types of inks used as the first to fourth inks, to thus improve the printing quality of an image and the like printed on the recording medium.

The printer 100 includes the storage unit 5 configured to store the first to fourth setting values for adjusting the first to fourth suction devices 51, 52, 53, and 54. The control unit 1 controls the first to fourth suction devices 51, 52, 53, and 54 using the first to fourth setting values stored in the storage unit 5. This makes it possible to easily control the first to fourth suction devices 51, 52, 53, and 54.

The storage unit 5 stores the first table indicating the correspondence of the ink name as ink information for specifying inks used as the first to fourth inks and the setting value. In the first table, the setting value is pre-registered as to the ink that is usable at the time when the printer 100 is shipped. The control unit 1 determines the first to fourth setting values based on the ink information of the first to fourth inks input from the input unit 7 and the first table, and stores the setting values in the storage unit 5. This makes it possible to easily determine the first to fourth setting values.

The control unit 1, which updates the first table to add, to the first table, correspondence information between the ink name of the unregistered ink and the setting value, can increase the types of inks that are usable as the first to fourth inks.

The ink information of the unregistered ink that is input from the input unit 7 includes the landing position deviation-influence degree and the ink mist-generation degree. The control unit 1 determines the setting value based on the second table in which the correspondence of the ink mist-generation degree and the landing position deviation-influence degree, and the setting value is written. This makes it possible to suitably determine the setting value of the unregistered ink.

The printing method 1 includes the setting value determination step for determining the first to fourth setting values with reference to the first table, and the flow rate adjustment step for adjusting the first to fourth suction devices 51, 52, 53, and 54 based on the first to fourth setting values. This makes it possible to adjust the airflow for suctioning the ink mist to an appropriate flow rate depending on the types of inks used as the first to fourth inks, to thus improve the printing quality of an image and the like printed on the recording medium.

In addition, the first table referred to in the setting value determination step is pre-registered with the setting value as to the ink that is usable at the time when the printer 100 is shipped, to thus easily determine the first to fourth setting values.

The printing method 1 includes the ink information acquisition step for acquiring ink information. In the setting value determination step, the first to fourth setting values are determined based on the ink information of the first to fourth inks acquired in the ink information acquisition step and the first table. This makes it possible to easily determine the first to fourth setting values.

The printing method 2 includes the table update step for updating the first table. In the table update step, the update is performed in a manner that the correspondence information between an ink name of the unregistered ink and the setting value is added to the first table, to thus increase the types of inks that are usable as the first to fourth inks.

The printing method 2 includes an ink information input step for inputting the ink information. The ink information of the unregistered ink that is input in the ink information input step contains the landing position deviation-influence degree and the ink mist-generation degree. In the table update step, the setting value is determined based on the second table in which the correspondence of the ink mist-generation degree determined from the tailing amount and the landing position deviation-influence degree, and the setting value is written. This makes it possible to suitably determine the setting value of the unregistered ink.

2. Embodiment 2

Figure 12:
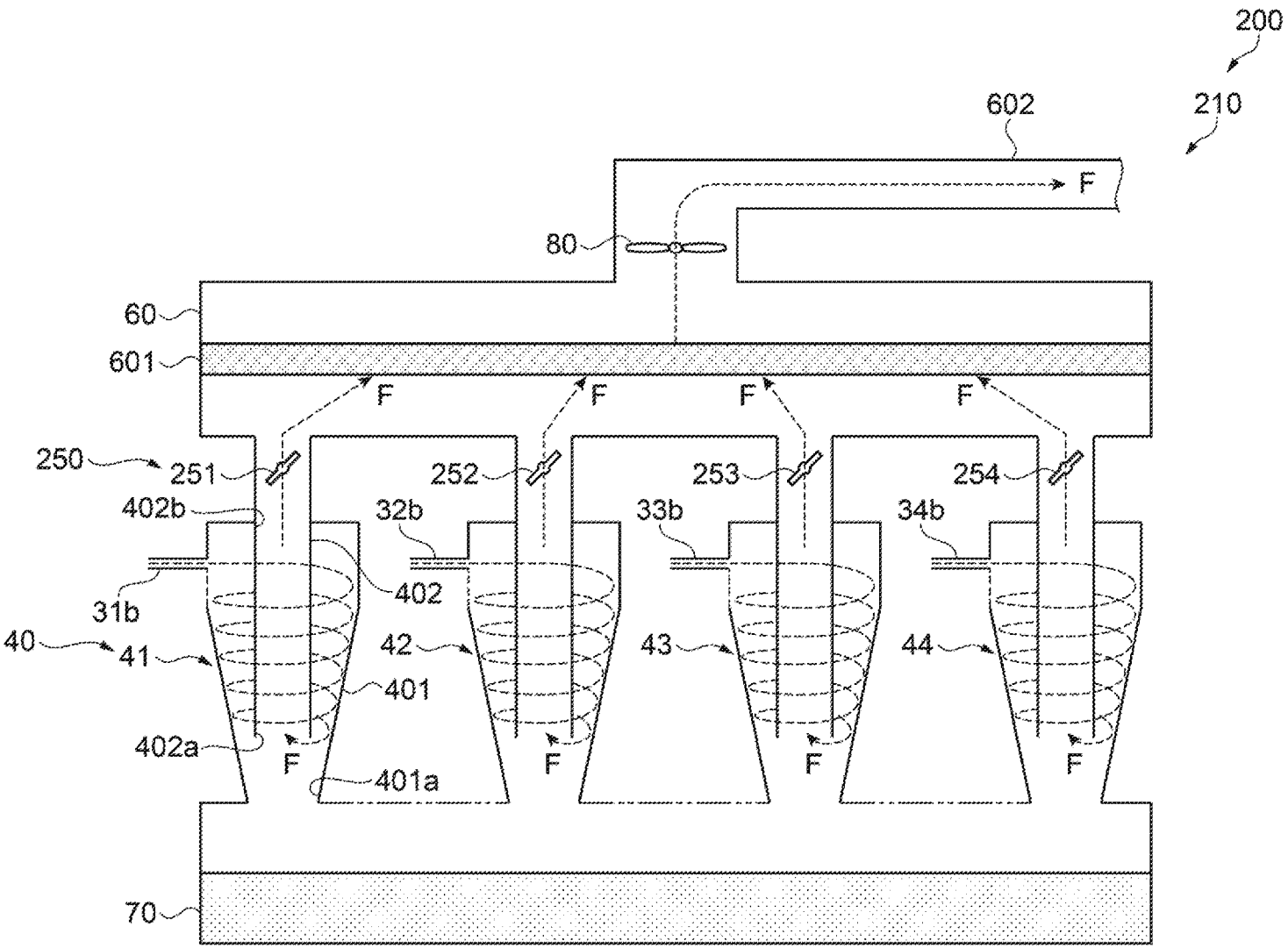
FIG. 12 is a conceptual view illustrating a configuration of a mist collection section of an inkjet printer according to Embodiment 2.
Figure 13:
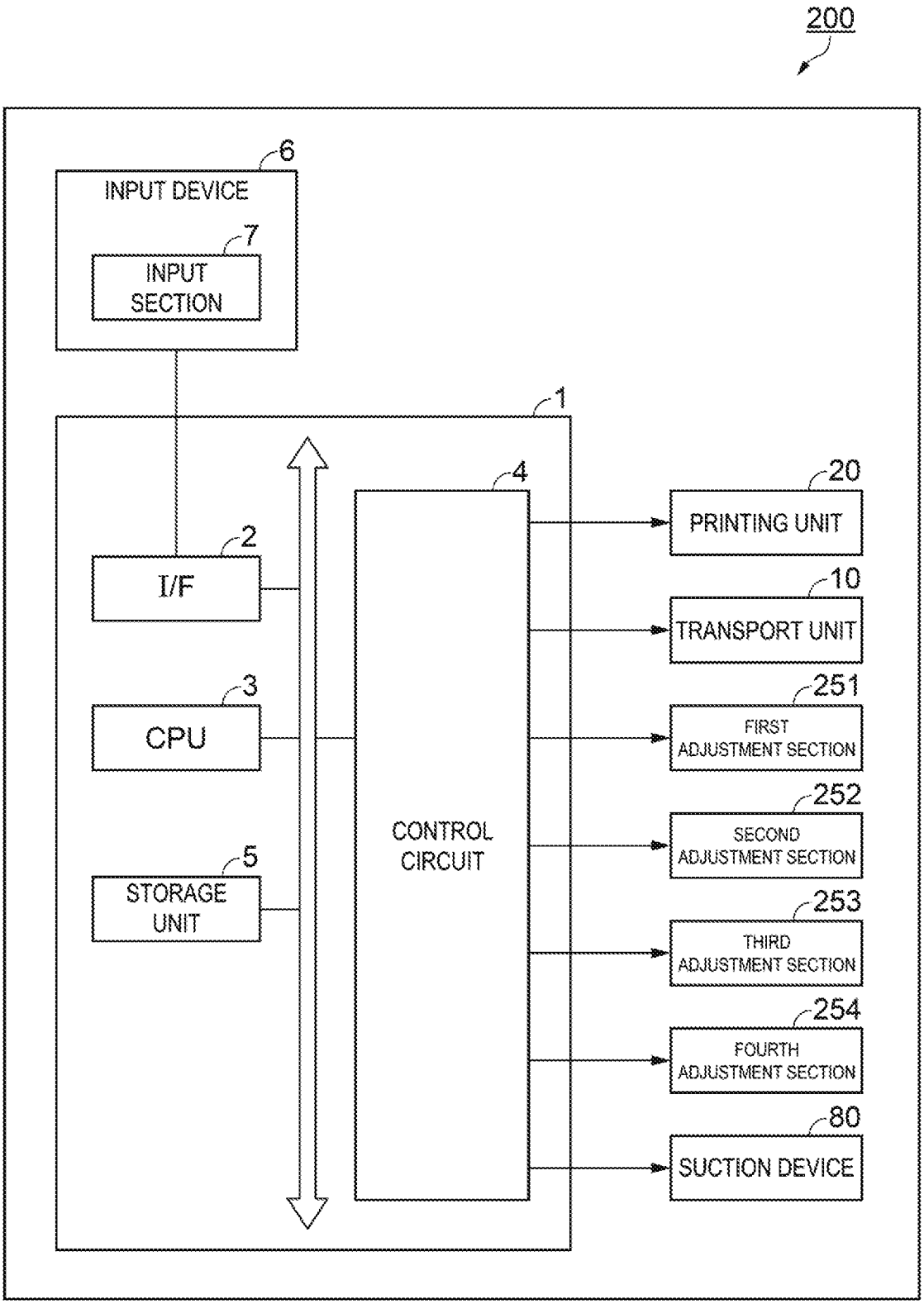
FIG. 13 is a block diagram schematically illustrating an electrical coupling of an inkjet printer.

FIG. 12 is a conceptual view illustrating a configuration of a mist collection section of an inkjet printer according to Embodiment 2. FIG. 13 is a block diagram schematically illustrating an electrical coupling of the inkjet printer. Note that configuration components as in the Embodiment 1 are referenced using like numbers, and no detailed descriptions for such components are provided below.

As illustrated in FIG. 12, a printer 200 includes the mist collection mechanism configured to collect mist generated in conjunction with discharging the ink. The mist collection mechanism is constituted by the suction unit 30 and a mist collection section 210. Moreover, the mist collection section 210 includes the cyclone 40, an adjustment unit 250, the filter section 60, a suction device 80, the liquid recovery unit 70, and the like.

The suction device 80 serves as a so-called blower, and is provided inside the exhaust duct 602. The suction device 80 is in communication with the first to fourth suction units 31, 32, 33, and 34, and is configured to generate the airflow for suctioning the ink mist in the first to fourth suction units 31, 32, 33, and 34. The blower as the suction device 80 rotates to generate the airflow F indicated by a dashed arrow in FIG. 12.

The adjustment unit 250 is constituted by first to fourth adjustment units 251, 252, 253, and 254. The first adjustment unit 251 is provided between the first cyclone 41 and the filter section 60, the second adjustment unit 252 is provided between the second cyclone 42 and the filter section 60, the third adjustment unit 253 is provided between the third cyclone 43 and the filter section 60, and the fourth adjustment unit 254 is provided between the fourth cyclone 44 and the filter section 60. Note that because the configurations of the first to fourth adjustment units 251, 252, 253, and 254 are the same as one another, a configuration of the first adjustment unit 251 will be described, and descriptions of configurations of the second to fourth adjustment units 252, 253, and 254 will be omitted.

It can also be said that the first adjustment unit 251 is provided in the first path being a path of the airflow flowing from the first suction unit 31 to the suction device 80. The first adjustment unit 251 is constituted by a so-called butterfly valve or the like configured to control the flow rate of the gas by, for example, causing a valve body attached to a valve rod to rotate about the valve rod as an axis to change an opening space of the cyclone muffler 402. Controlling the first adjustment unit 251 enables to adjust the flow rate of the airflow passing through the first suction unit 31 per unit time.

As illustrated in FIG. 13, the storage unit 5 includes an area for storing a first setting value for adjusting the first adjustment unit 251 and a second setting value for adjusting the second adjustment unit 252. Similarly, the storage unit 5 includes an area for storing a third setting value for adjusting the third adjustment unit 253 and a fourth setting value for adjusting the fourth adjustment unit 254.

The control circuit 4 is coupled to the first to fourth adjustment units 251, 252, 253, and 254, and is configured to generate control signals for controlling driving of the first to fourth adjustment units 251, 252, 253, and 254 based on the commands from the CPU 3. That is, the control unit 1 is configured to control the first to fourth adjustment units 251, 252, 253, and 254 based on the first to fourth setting values stored in the storage unit 5.

The control circuit 4 is coupled to the suction device 80, and is configured to generate a control signal for controlling driving of the suction device 80 based on the commands from the CPU 3.

Figure 14:
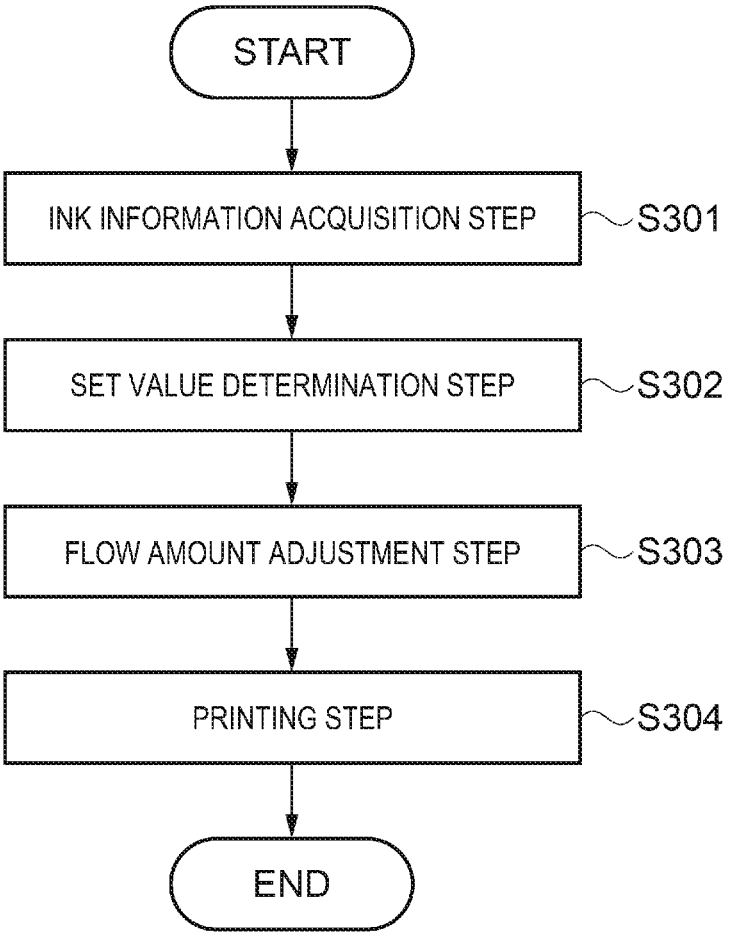
FIG. 14 is an explanatory flowchart illustrating a printing method 3.

FIG. 14 is an explanatory flowchart illustrating a printing method 3 for the inkjet printer. The printing method 3 for the printer 200 will be described with reference to FIG. 14. Note that step S301 and step S304 in the printing method 3 are the same as the step S101 and step S104 of the printing method 1 described in Embodiment 1, and thus descriptions of these steps will be omitted.

Step S302 is a setting value determination step for determining the first to fourth setting values with reference to the first table. The storage unit 5 stores the first table indicating the correspondence of the ink information and the setting value. In the first table, there is written the correspondence of the ink name as the ink information and the setting value. The setting value, which contains an amount of opening and closing of valves that constitute the first to fourth adjustment units 251, 252, 253, and 254 and a rotation angle, is set in three stages from "1" to "3" in Embodiment 2. For example, changing the setting value of the first adjustment unit 251 from 1 to 3 allows the flow rate of the airflow passing through the first suction unit 31 to increase in proportion to the setting value. Thus, the first table may be a table indicating the correspondence of the ink information and the flow rate of the airflow.

The control unit 1 determines the first to fourth setting values for controlling the first to fourth adjustment units 251, 252, 253, and 254 based on the ink information of the first to fourth inks acquired in the step S301 and the first table stored in the storage unit 5. For example, the control unit 1, when the ink information of the first ink includes the ink name of "Magenta B", determines the first setting value for driving the first adjustment unit 251 as "2" with reference to the first table. The control unit 1 then causes the first to fourth setting values having been determined to be stored in the predetermined storage area of the storage unit 5.

Step S303 is a flow rate adjustment step for adjusting the first to fourth adjustment units 251, 252, 253, and 254 based on the first to fourth setting values. The control unit 1 references the first to fourth setting values stored in the storage unit 5 to control the first to fourth adjustment units 251, 252, 253, and 254. This regulates the flow rate of the gas that is suctioned through the first to fourth suction ports 31*a*, 32*a*, 33*a*, and 34*a*.

Note that, in Embodiment 2, the configuration in which the first to fourth adjustment units 251, 252, 253, and 254 are provided inside the cyclone muffler 402 that communicates between the first to fourth cyclones 41 to 44 and the filter section 60, but the present disclosure is not limited this. A configuration may also be employed in which the first to fourth adjustment units are provided inside the first to fourth flow paths 31*b* to 34*b* that communicate between the first to fourth suction units 31 to 34 and the first to fourth cyclones 41 to 44.

In addition, in Embodiment 2, the first to fourth adjustment units 251, 252, 253, and 254 configured to change the opening space of the cyclone muffler 402 are exemplified, and the first to fourth adjustment units configured to change the opening space of the first to fourth suction ports 31*a* to 34*a* may also be used. The first to fourth adjustment units thus configured can be embodied by providing a shutter configured to change a length of the dimension C in FIG. 2.

As described above, according to the printer 200, the printing method 3 for the printer 200 according to Embodiment 2, the following advantageous effects can be achieved.

The printer 200 includes the first to fourth adjustment units 251, 252, 253, and 254 in the first to fourth paths. The first adjustment unit 251 is configured to adjust the flow rate of the airflow for suctioning the ink mist of the first ink, and the second adjustment unit 252 is configured to adjust the flow rate of the airflow for suctioning the ink mist of the second ink. Similarly, the third adjustment unit 253 is configured to adjust the flow rate of the airflow for suctioning the ink mist of the third ink, and the fourth adjustment unit 254 is configured to adjust the flow rate of the airflow for suctioning the ink mist of the fourth ink. This makes it possible to adjust the airflow for suctioning the ink mist to an appropriate flow rate depending on the types of inks used as the first to fourth inks, to thus improve the printing quality of an image and the like printed on the recording medium.

The printing method 3 includes the setting value determination step for determining the first to fourth setting values with reference to the first table, and the flow rate adjustment step for adjusting the first to fourth adjustment units 251, 252, 253, and 254 based on the first to fourth setting values. This makes it possible to adjust the airflow for suctioning the ink mist to an appropriate flow rate depending on the types of inks used as the first to fourth inks, to thus improve the printing quality of an image and the like printed on the recording medium.

Contents derived from the Embodiments will be described below.

The inkjet printer includes a transport unit configured to transport a recording medium in a transport direction, a first head having a nozzle row including a plurality of nozzles aligned in a direction intersecting the transport direction, the first head being configured to discharge a first ink as a droplet from the nozzle row onto the recording medium, a second head disposed downstream of the first head in the transport direction and including a plurality of nozzles aligned in the direction intersecting the transport direction, the second head being configured to discharge a second ink as a droplet from the nozzle row onto the recording medium, a first suction unit disposed between the first head and the second head in the transport direction, the first suction unit being configured to suction ink mist generated when the first ink is discharged from the first head, a second suction unit disposed downstream of the second head in the transport direction, the second suction unit being configured to suction ink mist generated when the second ink is discharged from the second head, a suction device coupled to the first suction unit and the second suction unit, the suction device being configured to generate an airflow for suctioning the ink mist in the first suction unit and the second suction unit, a first adjustment unit disposed either one of on a first path being a path of an airflow flowing from the first suction unit to the suction device, and at the suction device, the first adjustment unit being configured to adjust a flow rate of an airflow passing through the first suction unit per unit time, and a second adjustment unit disposed either one of on a second path being a path of an airflow flowing from the second suction unit to the suction device, and at the suction device, the second adjustment unit being configured to adjust a flow rate of an airflow passing through the second suction unit per unit time.

According to the above configuration, the first adjustment unit adjusts the flow rate of an airflow for suctioning the ink mist of the first ink, and the second adjustment unit adjusts the flow rate of an airflow for suctioning the ink mist of the second ink. This makes it possible to adjust the airflow for suctioning the ink mist to an appropriate flow rate depending on types of inks, to thus improve the printing quality of an image and the like printed on the recording medium.

The inkjet printer described above may include a control unit configured to control the first adjustment unit and the second adjustment unit, and a storage unit configured to store a first setting value for adjusting the first adjustment unit and a second setting value for adjusting the second adjustment unit, in which the control unit may be configured to control the first adjustment unit based on the first setting value, and may be configured to control the second adjustment unit based on the second setting value.

According to the above configuration, the storage unit stores the first setting value for adjusting the first adjustment unit and the second setting value for adjusting the second adjustment unit. The control unit controls the first adjustment unit and the second adjustment unit using the first setting value and the second setting value stored in the storage unit. This makes it possible to easily control the first adjustment unit and the second adjustment unit.

The inkjet printer described above may include an input unit to which ink information is input, in which the storage unit may be configured to store a table indicating a correspondence of the ink information including ink information of the first ink and ink information of the second ink, and the flow rate or the setting values, and the control unit may be configured to cause the storage unit to store the first setting value and the second setting value, based on the ink information input from the input unit, and the table.

According to the above configuration, the storage unit stores the table indicating the correspondence of the ink information about the ink that is usable as the first and second inks, and the flow rate or the setting values. The control unit determines the first setting value and the second setting value based on the ink information of the first ink and second ink that is input from the input unit, and the table, and causes the storage unit to store the setting values. This makes it possible to easily determine the first and second setting values.

In the inkjet printer described above, the input unit may be configured to accept an input of the flow rate corresponding to the ink information, or the setting values, and the control unit may be configured, when the table does not include correspondence information between the ink information input from the input unit, and the flow rate or the setting value, to update the table to add, to the table, the correspondence information between the ink information, and the flow rate or the setting value.

According to the above configuration, the table indicating the correspondence of the ink information, and the flow rate or the setting values can be added with the correspondence information that is input from the input unit, to thus increase the types of inks that are usable as the first and second inks.

In the inkjet printer described above, the ink information may include an ink mist-generation degree and either one of an ink color or a landing position deviation-influence degree.

According to the above configuration, the ink information includes either one of the ink color or the landing position deviation-influence degree, and the ink mist-generation degree, to thus suitably determine the setting value of the ink that does not contain the correspondence information.

The printing method is a printing method using an inkjet printer, the inkjet printer including a transport unit configured to transport a recording medium in a transport direction, a first head having a nozzle row including a plurality of nozzles aligned in a direction intersecting the transport direction, the first head being configured to discharge a first ink as a droplet from the nozzle row onto the recording medium, a second head disposed downstream of the first head in the transport direction and including a plurality of nozzles aligned in the direction intersecting the transport direction, the second head being configured to discharge a second ink as a droplet from the nozzle row onto the recording medium, a first suction unit disposed between the first head and the second head in the transport direction, the first suction unit being configured to suction ink mist generated when the first ink is discharged from the first head, a second suction unit disposed downstream of the second head in the transport direction, the second suction unit being configured to suction ink mist generated when the second ink is discharged from the second head, a suction device coupled to the first suction unit and the second suction unit, the suction device being configured to generate an airflow for suctioning the ink mist in the first suction unit and the second suction unit, a first adjustment unit disposed either one of on a first path being a path of an airflow flowing from the first suction unit to the suction device, and at the suction device, the first adjustment unit being configured to adjust a flow rate of the airflow passing through the first suction unit per unit time, a second adjustment unit disposed either one of on a second path being a path of an airflow flowing from the second suction unit to the suction device, and at the suction device, the second adjustment unit being configured to adjust a flow rate of an airflow passing through the second suction unit per unit time, and a storage unit configured to store a first setting value for adjusting the first adjustment unit and a second setting value for adjusting the second adjustment unit, and a table indicating a correspondence of ink information including ink information of the first ink and ink information of the second ink, and the flow rate or the setting value, the printing method including a setting value determination step for determining the first setting value and the second setting value with reference to the table, and a flow rate adjustment step for adjusting the first adjustment unit based on the first setting value, and adjusting the second adjustment unit based on the second setting value.

According to the above method, the first adjustment unit is adjusted, in the flow rate adjustment step, using the first setting value determined in the setting value determination step, to adjust the flow rate of an airflow for suctioning the ink mist of the first ink. The second adjustment unit is adjusted, in the flow rate adjustment step, using the second setting value determined in the setting value determination step, to adjust the flow rate of an airflow for suctioning the ink mist of the second ink. This makes it possible to adjust the airflow for suctioning the ink mist to an appropriate flow rate depending on types of inks used as the first and second inks, to thus improve the printing quality of an image and the like printed on the recording medium.

In addition, the table referred to in the setting value determination step is pre-registered with a table indicating a correspondence of the ink information about the ink that is usable as the first ink and the second ink, and the flow rate or the setting values, to thus easily determine the first and second setting values.

The printing method described above may include an ink information acquisition step for acquiring the ink information before the setting value determination step, and may determine, in the setting value determination step, the first setting value and the second setting value based on the ink information acquired in the ink information acquisition step and the table.

According to the above method, in the setting value determination step, the first and second setting values are determined based on the ink information that is input in the ink information acquisition step and the table. This makes it possible to easily determine the first and second setting values.

The printing method described above may include a table update step for adding correspondence information between the ink information acquired in the ink information acquisition step, and the flow rate or the setting values to the table when the table does not contain the correspondence information between the ink information, and the flow rate or the setting value.

According to the above method, in the table update step, the correspondence information between the ink information, and the flow rate or the setting value can be added to the table, to thus increase types of inks that are usable as the first and second inks.

In the printing method described above, the ink information may include an ink mist-generation degree and either one of an ink color and a landing position deviation-influence degree, and an ink information input step for determining the ink mist-generation degree to input the ink information including the ink mist-generation degree that is determined is included before the ink information acquisition step, in which a length of a tailing from the droplet discharged from the nozzle may be measured to determine the ink mist-generation degree.

According to the above method, in the ink information input step, the ink information is input containing either one of the ink color or the landing position deviation-influence degree, and the ink mist-generation degree determined from a tailing amount, to thus suitably determine the setting values of the inks that are usable as the first and second inks.

What is claimed is:

1. An inkjet printer, comprising:

a transport unit configured to transport a recording medium in a transport direction;

a first head having a nozzle row including a plurality of nozzles aligned in a direction intersecting the transport direction, the first head being configured to discharge a first ink in droplets from the nozzle row onto the recording medium;

a second head disposed downstream of the first head in the transport direction and having a nozzle row including a plurality of nozzles aligned in the direction intersecting the transport direction, the second head being configured to discharge a second ink in droplets from the nozzle row onto the recording medium;

a first suction unit disposed between the first head and the second head in the transport direction, the first suction unit being configured to suction ink mist generated when the first ink is discharged from the first head;

a second suction unit disposed downstream of the second head in the transport direction, the second suction unit being configured to suction ink mist generated when the second ink is discharged from the second head;

a suction device coupled to the first suction unit and the second suction unit, the suction device being configured to generate an airflow for suctioning the ink mist at the first suction unit and the second suction unit;

a first adjustment unit disposed either one of on a first path being a path of an airflow flowing from the first suction unit to the suction device, and at the suction device, the first adjustment unit being configured to adjust a flow rate of an airflow passing through the first suction unit per unit time;

a second adjustment unit disposed either one of on a second path being a path of an airflow flowing from the second suction unit to the suction device, and at the suction device, the second adjustment unit being configured to adjust a flow rate of an airflow passing through the second suction unit per unit time;

a control unit configured to control the first adjustment unit and the second adjustment unit;

a storage unit configured to store a first setting value for adjusting the first adjustment unit and a second setting value for adjusting the second adjustment unit; and an input unit by which ink information is input, wherein the control unit is configured to control the first adjustment unit based on the first setting value, and is configured to control the second adjustment unit based on the second setting value, the storage unit stores a table indicating a correspondence between the ink information including ink information of the first ink and ink information of the second ink, and the flow rate or setting values which includes the first setting value and the second setting value, and the control unit is configured to cause the storage unit to store the first setting value and the second setting value, based on the ink information input from the input unit, and the table.

2. The inkjet printer according to claim 1, wherein the input unit is configured to accept an input of the flow rate corresponding to the ink information, or the setting values, and the control unit is configured, when the table does not include correspondence information of the ink information input from the input section, and the flow rate or the setting values, to update the table to add, to the table, the correspondence information between the ink information, and the flow rate or the setting values.

3. The inkjet printer according to claim 2, wherein the ink information includes an ink mist-generation degree and either one of an ink color and a landing position deviation-influence degree.

4. A printing method, using an inkjet printer, the inkjet printer comprising:

a transport unit configured to transport a recording medium in a transport direction;

a first head having a nozzle row including a plurality of nozzles aligned in a direction intersecting the transport direction, the first head being configured to discharge a first ink in droplets from the nozzle row onto the recording medium;

a second head disposed downstream of the first head in the transport direction and having a nozzle row including a plurality of nozzles aligned in the direction intersecting the transport direction, the second head being configured to discharge a second ink in droplets from the nozzle row onto the recording medium;

a first suction unit disposed between the first head and the second head in the transport direction, the first suction unit being configured to suction ink mist generated when the first ink is discharged from the first head;

a second suction unit disposed downstream of the second head in the transport direction, the second suction unit being configured to suction ink mist generated when the second ink is discharged from the second head;

a suction device coupled to the first suction unit and the second suction unit, the suction device being configured to generate an airflow for suctioning the ink mist at the first suction unit and the second suction unit;

a first adjustment unit disposed either one of on a first path being a path of an airflow flowing from the first suction unit to the suction device, and at the suction device, the first adjustment unit being configured to adjust a flow rate of an airflow passing through the first suction unit per unit time;

a second adjustment unit disposed either one of on a second path being a path of an airflow flowing from the second suction unit to the suction device, and at the suction device, the second adjustment unit being configured to adjust a flow rate of an airflow passing through the second suction unit per unit time; and a storage unit configured to store a first setting value for adjusting the first adjustment unit and a second setting value for adjusting the second adjustment unit, and a table indicating a correspondence between ink information including ink information of the first ink and ink information of the second ink, and the flow rate or setting values which includes the first setting value and the second setting value, the printing method comprising:

a setting value determination step for determining the first setting value and the second setting value with reference to the table; and a flow rate adjustment step for adjusting the first adjustment unit based on the first setting value, and adjusting the second adjustment unit based on the second setting value.

5. The printing method according to claim 4, comprising:

an ink information acquisition step for acquiring the ink information before the setting value determination step; and determining, in the setting value determination step, the first setting value and the second setting value based on the ink information acquired in the ink information acquisition step and the table.

6. The printing method according to claim 5, comprising a table update step for adding, to the table, correspondence information between the ink information acquired in the ink information acquisition step, and the flow rate or the setting values when the table does not include the correspondence information between the ink information, and the flow rate or the setting value.

7. The printing method according to claim 6, wherein the ink information includes an ink mist-generation degree and either one of an ink color and a landing position deviation-influence degree, the printing method including, before the ink information acquisition step, an ink information input step for determining the ink mist-generation degree and inputting the ink information including the determined ink mist-generation degree, wherein the ink mist-generation degree is obtained by measuring a tailing length from the droplet discharged from the nozzle.

* * * * *